US010167839B2

(12) United States Patent
Inada et al.

(10) Patent No.: US 10,167,839 B2
(45) Date of Patent: Jan. 1, 2019

(54) IGNITION CONTROL DEVICE AND IGNITION CONTROL METHOD FOR INTERNAL COMBUSTION ENGINE

(71) Applicant: Mitsubishi Electric Corporation, Tokyo (JP)

(72) Inventors: Takahiko Inada, Tokyo (JP); Takahiro Enomoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 273 days.

(21) Appl. No.: 15/291,166

(22) Filed: Oct. 12, 2016

(65) Prior Publication Data

US 2017/0292492 A1 Oct. 12, 2017

(30) Foreign Application Priority Data

Apr. 12, 2016 (JP) ..... 2016-079358

(51) Int. Cl.
*F02P 3/04* (2006.01)
*F02P 1/08* (2006.01)
(Continued)

(52) U.S. Cl.
CPC ..... *F02P 3/0407* (2013.01); *F02P 1/083* (2013.01); *F02P 9/002* (2013.01); *F02P 17/12* (2013.01); *H01T 13/20* (2013.01)

(58) Field of Classification Search
CPC ..... F02P 3/0407; F02P 3/0414; F02P 3/055–3/0554; F01P 11/00; F01P 11/02
(Continued)

(56) References Cited

U.S. PATENT DOCUMENTS 9,341,155 B2 * 5/2016 Kurahashi ..... F02P 15/08
2015/0192100 A1 * 7/2015 Kurahashi ..... F02P 15/08 123/406.12
2015/0330290 A1 * 11/2015 Glugla ..... F02P 9/002 123/298

FOREIGN PATENT DOCUMENTS

JP 2007-85306 A 4/2007
JP 2010-261395 A 11/2010
(Continued)

OTHER PUBLICATIONS

Communication dated Mar. 14, 2017, issued from the Japan Patent Office in the counterpart Japanese Application No. 2016-079358.
(Continued)

*Primary Examiner* — Erick Solis
*Assistant Examiner* — Robert Werner
(74) *Attorney, Agent, or Firm* — Sughrue Mion, PLLC; Richard C. Turner

(57) ABSTRACT

The ignition control device includes a spark plug that includes a first electrode and a second electrode disposed so as to oppose each other, an ignition coil that includes a plurality of sets of a primary coil and a secondary coil, generates a high voltage in the secondary coil by energizing or interrupting a primary current supplied to the primary coil, and applies the generated high voltage to the first electrode, and a control unit that, in a case where a plurality of the primary coils are driven during a single ignition process, temporarily stops energization of a primary current supplied to a second primary coil when a primary current supplied to a first primary coil is interrupted, and re-energizes the primary current supplied to the second primary coil following the elapse of an energization stoppage period.

19 Claims, 9 Drawing Sheets

(51) Int. Cl.
*F02P 9/00* (2006.01)
*F02P 17/12* (2006.01)
*H01T 13/20* (2006.01)

(58) Field of Classification Search
USPC ..... 123/609, 620, 621, 622, 630, 636, 637, 123/644, 649
See application file for complete search history.

(56) References Cited

FOREIGN PATENT DOCUMENTS

| | | | |
|---|---|---|---|
| JP | 2015-129465 | A | 7/2015 |
| WO | 2015/071245 | A1 | 5/2015 |

OTHER PUBLICATIONS

Communication dated Aug. 15, 2017 from the Japanese Patent Office in counterpart Application No. 2016-079358.

* cited by examiner

IGNITION CONTROL DEVICE AND IGNITION CONTROL METHOD FOR INTERNAL COMBUSTION ENGINE

BACKGROUND OF THE INVENTION

1. Field of the Invention

This invention relates to an ignition control device and an ignition control method for an internal combustion engine, with which to ignite a combustible air-fuel mixture in a combustion chamber of the internal combustion engine.

2. Description of the Related Art

In recent years, problems relating to environmental degradation and fuel depletion have become more serious, and addressing these problems has become an urgent task in many industries, including the automobile industry. In one technique proposed in response to these problems, a dramatic improvement in fuel efficiency is achieved by reducing pumping loss through the use of exhaust gas recirculation (EGR).

However, burned gas discharged as exhaust gas is non-combustible and has a larger heat capacity than air. Therefore, when a large amount of burned gas is taken back into the combustion chamber by EGR, the ignitability and combustibility of the combustible air-fuel mixture deteriorate.

In an ignition device for an internal combustion engine proposed as a solution to this problem, a spark discharge is maintained for a longer period using two pairs of coils so that the ignitability of the combustible air-fuel mixture can be stabilized and a stable flame kernel can be formed, and as a result, the combustibility of the combustible air-fuel mixture can be stabilized (see Japanese Patent Application Publication No. 2015-129465, for example).

In this ignition device for an internal combustion engine, first and second ignition signals are generated such that a first discharge period extending from the start to the end of a discharge generated by energizing a first primary coil partially overlaps a second discharge period extending from the start to the end of a discharge generated by energizing a second primary coil, a start timing of the first discharge period is prior to a start timing of the second discharge period, and an overlapping discharge period between the first and second discharge periods corresponds to a set overlap period.

Further, the set overlap period is set in accordance with the first discharge period, a blow-out threshold serving as a minimum value of a discharge current value at which blow-out does not occur, and a minimum peak value serving as the discharge current value at the start timing of the first discharge period so that a peak discharge current is minimized within a range in which blow-out does not occur.

According to this ignition device for an internal combustion engine, by maintaining the spark discharge for a longer period so that the ignitability and combustibility of the combustible air-fuel mixture are stabilized, a large amount of burned gas can be introduced into the combustion chamber by EGR, thereby reducing the pumping loss, and as a result, an improvement in fuel efficiency can be expected.

SUMMARY OF THE INVENTION

In the ignition device for an internal combustion engine described in Japanese Patent Application Publication No. 2015-129465, a drive circuit that causes spark plugs provided in respective cylinders to generate spark discharges includes two pairs of coils, and each pair of coils is formed by winding a primary coil and a secondary coil around a core. Further, a transistor serving as a switching element is connected to the primary coil.

Here, an ignition signal is output to each pair of coils from an engine control device, and when the transistor is switched ON in response to the ignition signal being switched ON, a primary current is supplied to the primary coil. When the transistor is subsequently switched OFF in response to the ignition signal being switched OFF, a high voltage is generated between respective ends of the secondary coil such that a spark discharge is generated between electrodes of the spark plug. The engine control device will be referred to hereafter as an engine control unit (ECU).

At this time, the ignition signals are output at a slight time difference in each combustion cycle, and discharge is started from a point at which a first ignition signal is switched OFF, with the result that a secondary coil current is supplied. A discharge current generated between the electrodes of the spark plug is equal to a sum of the respective secondary coil currents.

If, however, the ignition signal output to the other pair of coils is ON when the first ignition signal is switched OFF, the impedance of the other coil pair may decrease such that some of the energy supplied to the spark plug leaks. In a high pressure condition, therefore, in which a high voltage is required to generate the spark discharge, dielectric breakdown may not be possible, and as a result, an engine misfire may occur.

Further, when an avalanche diode is connected between the spark plug and the secondary coil as a high voltage diode for preventing a reverse current from flowing through the secondary coil with the aim of preventing energy leakage, a high-performance avalanche diode exhibiting high voltage resistance must be used, leading to an increase in cost.

This invention has been designed to solve the problems described above, and an object thereof is to obtain an ignition control device and an ignition control method for an internal combustion engine, with which an engine misfire can be prevented at low cost even when ignition signals are output at a slight time difference in each combustion cycle.

An ignition control device for an internal combustion engine according to this invention includes a spark plug that includes a first electrode and a second electrode disposed so as to oppose each other via a gap, and generates a spark discharge in the gap in order to ignite a combustible air-fuel mixture existing in a combustion chamber of the internal combustion engine, an ignition coil that includes a plurality of sets of a primary coil and a secondary coil, generates a high voltage in the secondary coil by energizing or interrupting a primary current supplied to the primary coil, and applies the generated high voltage to the first electrode, and a control unit that, in a case where a plurality of the primary coils are driven during a single ignition process, temporarily stops energization of a primary current supplied to a second primary coil when a primary current supplied to a first primary coil is interrupted, and re-energizes the primary current supplied to the second primary coil following the elapse of an energization stoppage period.

Further, an ignition control method for an internal combustion engine according to this invention is realized in an internal combustion engine having a spark plug that includes a first electrode and a second electrode disposed so as to oppose each other via a gap, and generates a spark discharge in the gap in order to ignite a combustible air-fuel mixture existing in a combustion chamber of the internal combustion engine, and an ignition coil that includes a plurality of sets of a primary coil and a secondary coil, generates a high voltage in the secondary coil by energizing or interrupting a primary current supplied to the primary coil, and applies the generated high voltage to the first electrode, wherein the ignition control method is implemented in a case where a plurality of the primary coils are driven during a single ignition process, and includes the steps of temporarily stopping energization of a primary current supplied to a second primary coil when a primary current supplied to a first primary coil is interrupted, and re-energizing the primary current supplied to the second primary coil following the elapse of an energization stoppage period.

With the ignition control device and ignition control method for an internal combustion engine according to this invention, in a case where a plurality of primary coils are driven during a single ignition process, energization of the primary current supplied to the second primary coil is temporarily stopped when the primary current supplied to the first primary coil is interrupted, and the primary current supplied to the second primary coil is re-energized following the elapse of the energization stoppage period.

As a result, an engine misfire can be prevented at low cost even when ignition signals are output at a slight time difference in each combustion cycle.

DESCRIPTION OF THE PREFERRED EMBODIMENTS

Figure 1:
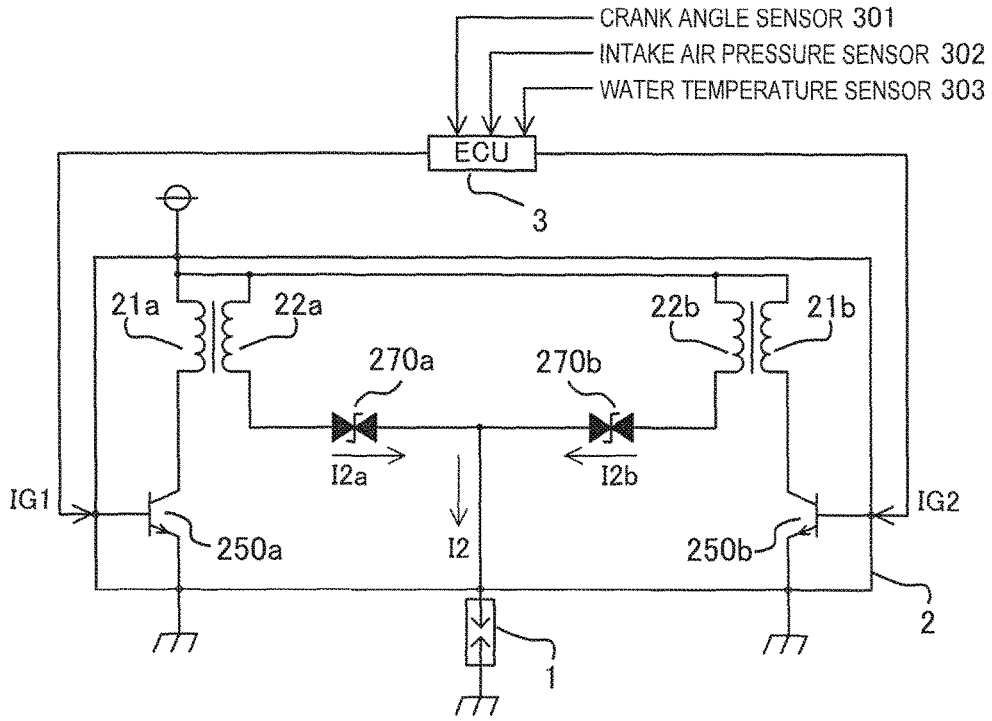
FIG. 1 is a view showing a configuration of an ignition control device for an internal combustion engine according to a first embodiment of this invention.

Preferred embodiments of an ignition control device and an ignition control method for an internal combustion engine according to this invention will be described below using the drawings. Identical or corresponding parts of the drawings will be described using identical reference numerals.

First Embodiment

FIG. 1 is a view showing a configuration of an ignition control device for an internal combustion engine according to a first embodiment of this invention. In FIG. 1, a spark plug 1 connected to an ignition coil 2 is provided in each cylinder of the internal combustion engine. Note that FIG. 1 shows a single extracted cylinder.

The spark plug 1 includes a first electrode to which an ignition voltage for generating a spark discharge is applied, and a second electrode that opposes the first electrode via a gap and is maintained at a ground potential. Further, when an ignition voltage of the ignition coil 2 is applied between the electrodes, the spark plug 1 generates a spark discharge, thereby igniting a combustible air-fuel mixture existing in a combustion chamber by either forced ignition or self-ignition such that the combustible air-fuel mixture burns. Hereafter, forced ignition and self-ignition will be referred to simply as ignition.

The ignition coil 2 is mechanically fixed to the spark plug 1 so as to be integrated therewith, and includes two pairs of coils constituted by a primary coil 21*a* and a secondary coil 22*a*, the primary coil 21*a* being connected at one end to a power supply constituted by a battery and the secondary coil 22*a* being coupled to the primary coil 21*a* via a magnetic core, and a primary coil 21*b* and a secondary coil 22*b*, the primary coil 21*b* being connected at one end to the power supply and the secondary coil 22*b* being coupled to the primary coil 21*b* via a magnetic core.

Further, power transistors 250*a*, 250*b* serving as switching elements are connected respectively to the other ends of the primary coils 21*a*, 21*b* of the respective coil pairs. Furthermore, the secondary coils 22*a*, 22*b* of the respective coil pairs are connected at one end to the power supply constituted by a battery, while the other ends thereof are connected to the first electrode of the spark plug 1 via avalanche diodes 270*a*, 270*b* for preventing reverse currents from flowing through the respective secondary coils 22*a*, 22*b*.

An ECU 3 serving as a control unit obtains output from various sensors such as a crank angle sensor 301, an intake air pressure sensor 302, and a water temperature sensor 303, determines an operating condition of the internal combustion engine on the basis of information from the various sensors, and performs various types of control relating to fuel, ignition, and so on. Further, the coil pairs respectively receive ignition signals IG1, IG2 for activating the respective power transistors 250*a*, 250*b* from the ECU 3.

Figure 2:
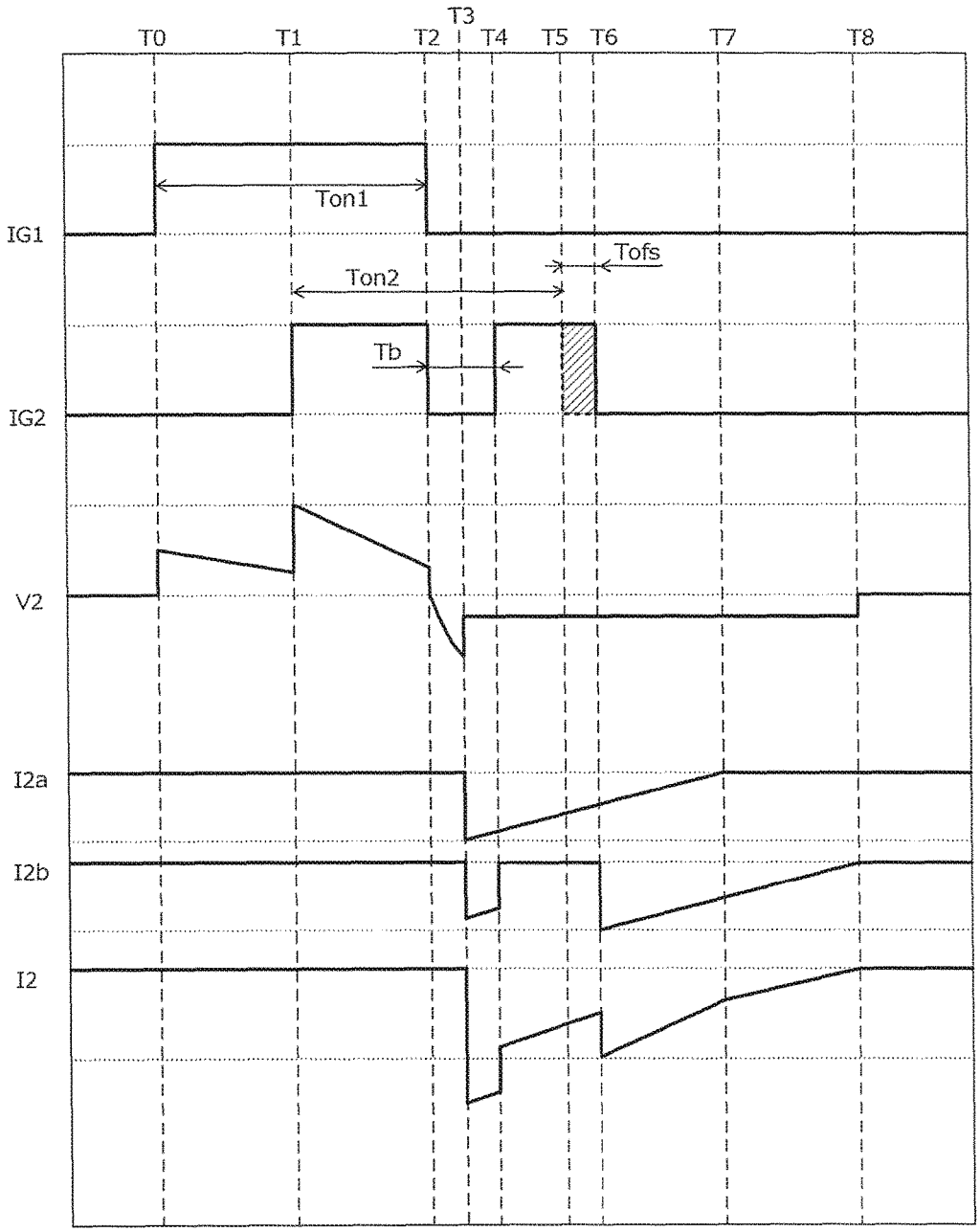
FIG. 2 is a timing chart showing an operation of the ignition control device for an internal combustion engine according to the first embodiment of this invention.

Next, referring to FIG. 2, a specific operation of the ignition control device for an internal combustion engine having the above configuration will be described. FIG. 2 is a timing chart showing an operation of the ignition control device for an internal combustion engine according to the first embodiment of this invention. In FIG. 2, the abscissa shows time, but may show the crank angle instead.

First, the ECU 3 determines the operating condition of the internal combustion engine on the basis of the information from the various sensors, and outputs the ignition signals IG1, IG2 at times T0, T1 serving as timings at which the two coil pairs of the ignition coil 2 are activated. Here, the spark discharge can be maintained for a longer period by inserting a slight time difference between the timings at which the two coil pairs are activated such that T1>T0.

When the first ignition signal IG1 shifts to a high level at the time T0, a primary current is supplied to the primary coil 21*a* of the two coil pairs provided in the ignition coil 2 such that energy starts to be stored therein.

Next, at a time T2 serving as a timing at which the ignition signal IG1 is switched from the high level to a low level, a secondary voltage V2, which is a negative high voltage, is generated in the secondary coil 22*a* and supplied to the spark plug 1. Hereafter, the high level and the low level will be referred to respectively as an "H level" and an "L level".

Meanwhile, when the ignition signal IG2 output to the other coil pair shifts to the H level at the time T1, a primary current is supplied to the primary coil 21*b* so that energy starts to be stored therein. At this time, during the ignition control disclosed in Japanese Patent Application Publication No. 2015-129465, the ignition signal IG2 remains at the H level continuously from the time T1 to a time T5.

In this case, the ignition signal IG2 output to the other coil pair is at the H level at the time T2, i.e. when the first ignition signal IG1 is switched from the H level to the L level, and therefore the impedance of the secondary coil 22*b* of the other coil pair decreases.

Figure 3:
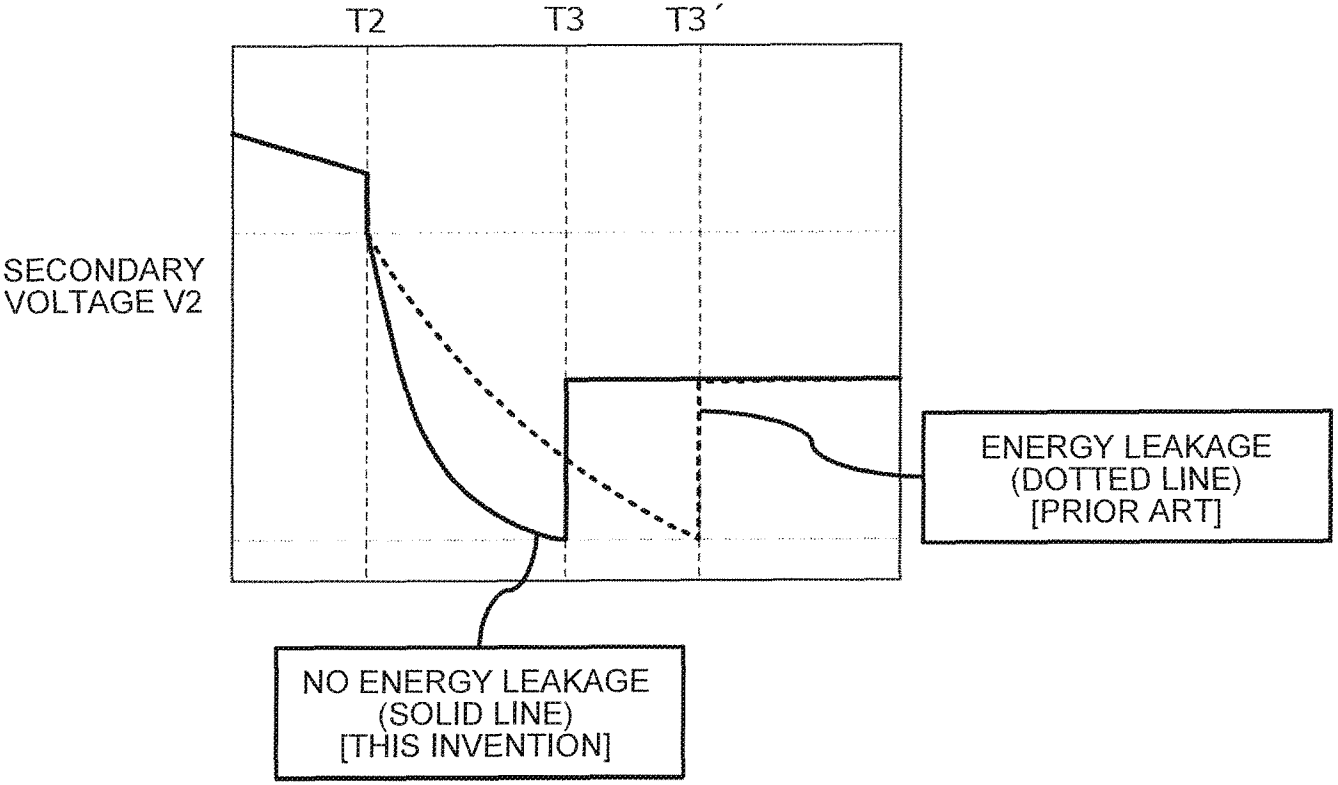
FIG. 3 is an illustrative view showing a partial enlargement of a secondary voltage shown in FIG. 2.

Here, referring to FIG. 3, variation in the secondary voltage V2 from the time T2, at which the negative high voltage supplied to the spark plug 1 starts to be generated, to a time T3, at which dielectric breakdown occurs according to this invention, and a time T3', at which dielectric breakdown occurs according to the prior art, will be described. FIG. 3 is an illustrative view showing a partial enlargement of the secondary voltage shown in FIG. 2. In FIG. 3, the abscissa shows time, but may show the crank angle instead.

When the operating condition of the internal combustion engine corresponds to a high pressure condition in which a high voltage is required to generate the spark discharge, some of the energy supplied to the spark plug 1 may leak from the avalanche diode 270*b* connected to the secondary coil 22*b*.

When, at this time, the impedance of the secondary coil 22*b* of the other coil pair is low, as described above, a fall time of the secondary voltage V2 is delayed in comparison with the fall time in a case where no energy leakage has occurred, as shown by a dotted line in FIG. 3. Hence, when dielectric breakdown becomes impossible in the high pressure condition, an engine misfire occurs.

In the first embodiment of this invention, therefore, as shown in FIG. 2, at the time T2 when the first ignition signal IG1 is switched from the H level to the L level, the ignition signal IG2 output to the other coil pair is also switched temporarily from the H level to the L level. In other words, at the time T2 serving as the timing at which the ignition signals IG1, IG2 are switched from the H level to the L level, a secondary voltage constituted by a negative high voltage is generated likewise by the secondary coil 22*b* and supplied to the spark plug 1.

Thus, partial leakage of the energy supplied to the spark plug 1 from the avalanche diode 270*b* connected to the secondary coil 22*b* is eliminated. Accordingly, dielectric breakdown becomes possible, and as a result, an engine misfire can be prevented from occurring. Moreover, there is no need to use high-performance avalanche diodes exhibiting high voltage resistance as the avalanche diodes 270*a*, 270*b*.

Note that an energization stoppage period Tb during which the ignition signal IG2 is temporarily switched to the L level is set on the basis of the operating condition of the internal combustion engine, which is determined by the ECU 3. More specifically, the energization stoppage period Tb is set using a value obtained in advance by experiment as a reference period.

Particularly in the high pressure condition, in which a high voltage is required to generate the spark discharge, the period extending from the time T2 at which the negative high voltage starts to be generated to the time T3 at which dielectric breakdown occurs lengthens. In this case, therefore, the energization stoppage period Tb during which the ignition signal IG2 is switched to the L level must be set to be longer than the reference period. Here, a value within a range of several tens of μs to several hundred μs, which is obtained by applying a degree of leeway to the value obtained in advance by experiment, may be set as the energization stoppage period Tb.

Further, during the period in which the ignition signals IG1, IG2 are both at the L level, which extends from the time T3 at which dielectric breakdown occurs to a time T4 at which the ignition signal IG2 is switched back to the H level, discharge secondary currents I2*a*, I2*b* are supplied from the respective coil pairs, and therefore this period is longer than a corresponding period in a case where only the ignition signal IG1 is at the L level. By setting an optimum value in accordance with the operating condition, however, a discharge secondary current I2 is not supplied unnecessarily, and as a result, wear on the spark plug 1 can be suppressed.

In the ignition device according to the prior art, following the time T4 at which the ignition signal IG2 is switched back to the H level, the ignition signal IG2 is set at the L level at the time T5 in order to align an H level period Ton2 of the ignition signal IG2 with an H level period Ton1 of the ignition signal IG1. In the first embodiment of this invention, on the other hand, a re-energization period during which the ignition signal IG2 is switched to the H level is set on the basis of the energization stoppage period Tb during which the ignition signal IG2 is temporarily switched to the L level.

As described above, in the high pressure condition in which a high voltage is required to generate the spark discharge, the period extending from the time T2 at which the negative high voltage starts to be generated to the time T3 at which dielectric breakdown occurs is lengthened, with the result that a large amount of the energy stored by supplying a primary current to the primary coil 21*b* is consumed.

Therefore, to compensate for the energy consumed during the energization stoppage period Tb, the period Ton2 during which the ignition signal IG2 is switched to the H level is lengthened by Tofs, or in other words set at Ton2+Tofs, whereupon the ignition signal IG2 is switched to the L level at a time T6. In so doing, a situation in which an actual spark discharge period becomes shorter than a desired spark discharge period, leading to combustion instability, can be avoided.

Following the time T6 at which the ignition signal IG2 is switched to the L level, the discharge secondary current I2*b* is supplied likewise from the secondary coil 22*b*, leading to an increase in the discharge secondary current I2 supplied to the spark plug 1, the discharge secondary current I2 being equal to the sum of the discharge secondary currents I2*a*, I2*b*.

Next, at a time T7, a primary current is supplied to the primary coil 21*a* such that all of the energy stored therein is consumed, whereby the discharge secondary current I2*a* supplied from the secondary coil 22*a* falls to zero. Further, at a time T8, a primary current is supplied to the primary coil 21*b* such that all of the energy stored therein is consumed, whereby the discharge secondary current I2*b* supplied from the secondary coil 22*b* falls to zero. As a result, the discharge secondary current I2 supplied to the spark plug 1 falls to zero, whereby the spark discharge is terminated.

According to the first embodiment, as described above, in a case where a plurality of primary coils are driven during a single ignition process, energization of the primary current supplied to the second primary coil is temporarily stopped when the primary current supplied to the first primary coil is interrupted, and the primary current supplied to the second primary coil is re-energized following the elapse of the energization stoppage period.

As a result, an engine misfire can be prevented from occurring even in a case where respective ignition signals are output at a slight time difference in each combustion cycle.

Moreover, high-performance avalanche diodes exhibiting high voltage resistance need not be used, and therefore a cost reduction can be achieved.

Hence, by employing this ignition control device for an internal combustion engine and maintaining the spark discharge for a longer period in order to stabilize the ignitability and combustibility of the combustible air-fuel mixture, a large amount of burned gas can be introduced into the combustion chamber by EGR, thereby reducing the pumping loss, and as a result, an improvement in fuel efficiency can be achieved.

Further, the control unit sets the energization stoppage period, during which energization of the primary current supplied to the second primary coil is temporarily stopped, on the basis of the operating condition of the internal combustion engine, and sets the energization stoppage period to be longer than the reference period particularly when the operating condition of the internal combustion engine corresponds to the high pressure condition in which a high voltage is required to generate the spark discharge. Thus, the discharge secondary current is not supplied unnecessarily, and as a result, wear on the spark plug can be suppressed.

Furthermore, the control unit sets the re-energization period during which the primary current supplied to the second primary coil is re-energized in accordance with the energization stoppage period. As a result, a situation in which the actual spark discharge period becomes shorter than the desired spark discharge period, leading to combustion instability, can be prevented from occurring.

Second Embodiment

Figure 4:
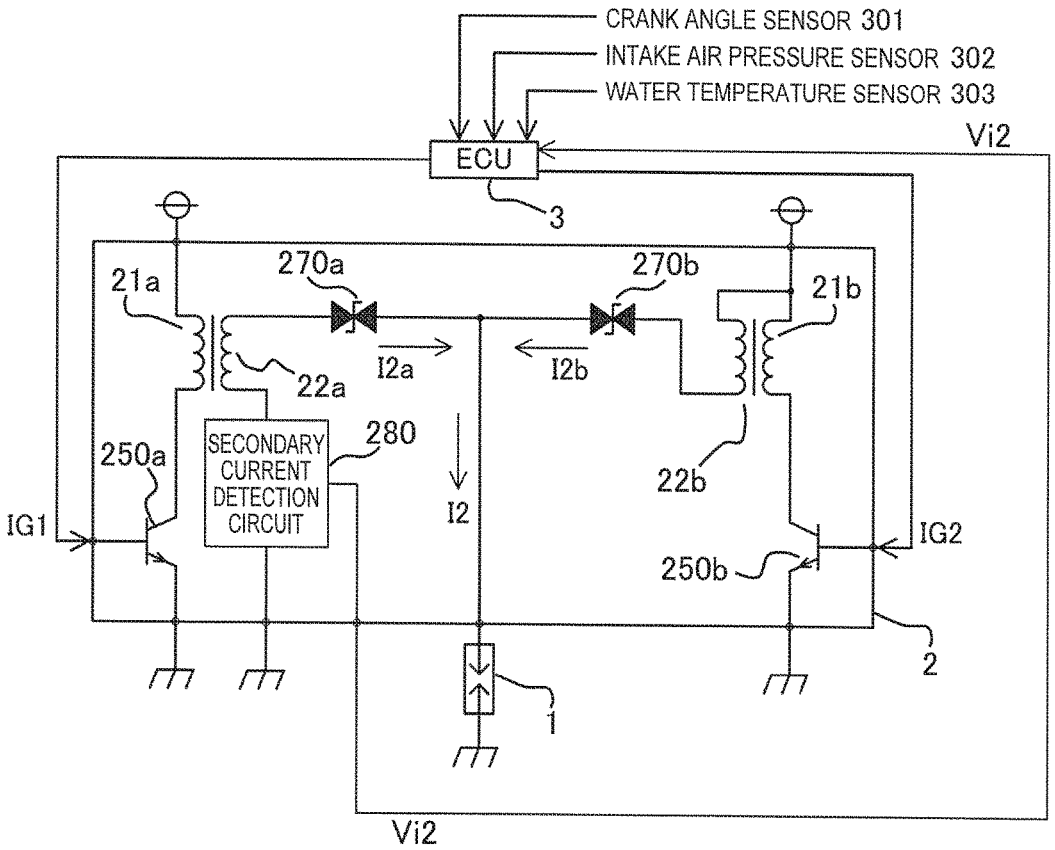
FIG. 4 is a view showing a configuration of an ignition control device for an internal combustion engine according to a second embodiment of this invention.

FIG. 4 is a view showing a configuration of an ignition control device for an internal combustion engine according to a second embodiment of this invention. In FIG. 4, the ignition coil 2 includes a secondary current detection circuit 280 that detects the discharge secondary current I2*a* supplied from the secondary coil 22*a*. All other configurations are identical to the first embodiment, shown in FIG. 1, and therefore description thereof has been omitted.

The secondary current detection circuit 280 inputs a detected secondary current output Vi2 into the ECU 3, and the ECU 3 re-energizes the primary current supplied to the primary coil 21*b* on the basis of the value of the secondary current output Vi2. Further, one end of the secondary current detection circuit 280 is connected to the secondary coil 22*a*, and the other end is grounded.

Next, referring to FIG. 2, a specific operation of the ignition control device for an internal combustion engine having the above configuration will be described. As described above in the first embodiment, dielectric breakdown occurs at the time T3, whereupon the discharge secondary current I2*a* is supplied to the spark plug 1 from the secondary coil 22*a*.

At this time, the ECU 3 determines from the secondary current output Vi2 whether or not the discharge secondary current I2*a* is lower than a threshold set at −50 mA, for example. When the discharge secondary current I2*a* is lower than the threshold, the ECU 3 switches the ignition signal IG2 from the L level to the H level in order to re-energize the primary coil 21*b*.

As a result, the primary coil 21*b* can be re-energized immediately after the time T3 at which dielectric breakdown occurs, and therefore a supply period of the discharge secondary current I2*b* supplied from the secondary coil 22*b* can be shortened and the period extending from the time T3 to the time T4, during which the discharge secondary current I2 supplied to the spark plug 1 increases, can also be shortened.

According to the second embodiment, as described above, the control unit interrupts the primary current supplied to the first primary coil, and then re-energizes the primary current supplied to the second primary coil on the basis of the current detected by the secondary current detection circuit. Hence, an unnecessarily large discharge secondary current is not supplied, and as a result, wear on the spark plug can be suppressed.

Third Embodiment

Figure 5:
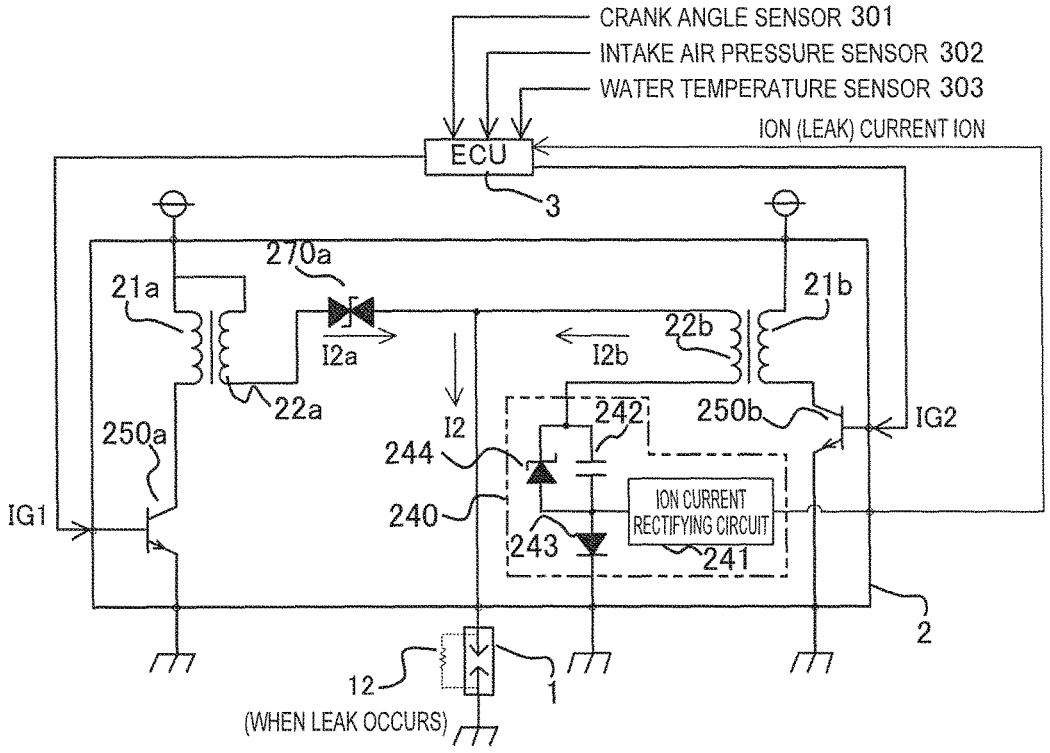
FIG. 5 is a view showing a configuration of an ignition control device for an internal combustion engine according to a third embodiment of this invention.

FIG. 5 is a view showing a configuration of an ignition control device for an internal combustion engine according to a third embodiment of this invention. In FIG. 5, the ignition coil 2 includes an ion current detection circuit 240 provided in relation to the secondary coil 22*b*. All other configurations are identical to the first embodiment, shown in FIG. 1, and therefore description thereof has been omitted.

The ion current detection circuit 240 applies a bias voltage of approximately several hundred V between the first electrode and the second electrode of the spark plug 1, and detects an ion current that flows on the basis of an amount of ions generated when the combustible air-fuel mixture in the combustion chamber is burned, and a leak current generated when an insulation resistance value between the first electrode and the second electrode of the spark plug 1 decreases such that the spark plug smolders. Note that when the spark plug smolders, a leak path 12 indicated by a dotted line in FIG. 5 is formed in the spark plug 1.

The ion current detection circuit 240 provided in the ignition coil 2 includes a bias circuit, or in other words a capacitor 242, connected to a low voltage side of the secondary coil 22*b*, a diode 243 inserted between the capacitor 242 and the ground, and a voltage limiting Zener diode 244 connected in parallel to the capacitor 242.

The capacitor 242 and the Zener diode 244 are inserted between the low voltage side of the secondary coil 22*b* and the ground so as to form a charging path for charging the bias voltage to the capacitor 242 when the discharge secondary current I2*b* is generated. The bias voltage functions as a power supply used during ion current detection, and the detected ion current is subjected to multiplication processing or the like by an ion current rectifying circuit 241.

The ECU 3 obtains an ion (leak) current ION output by the ion current rectifying circuit 241. Further, the ECU 3 converts the current signal into a voltage signal and converts the voltage signal into a signal that can be processed by a microcomputer via an AD converter. Note that the output of the ion current rectifying circuit 241 includes a high frequency signal, and therefore an AD conversion sampling rate is preferably set at a high speed of approximately several μs to several tens of μs.

Furthermore, the ECU 3 processes the converted voltage signal to determine whether or not a leak has occurred in the spark plug 1 due to a reduction in the insulation resistance value. Here, as shown by the dotted line in FIG. 3, when a leak occurs in the spark plug 1, the fall time of the secondary voltage V2 is delayed in comparison with the fall time in a case where no leak has occurred, or in other words when no energy has leaked out.

As a result, the period from the time T2, at which the negative high voltage starts to be generated, to the time T3', at which dielectric breakdown occurs, also lengthens. In this case, therefore, it is necessary to set the energization stoppage period Tb starting from the time T2, during which the ignition signal IG2 is temporarily switched to the L level, to be longer than the reference period.

Next, referring to FIG. 6, a specific operation of the ignition control device for an internal combustion engine having the above configuration will be described. As described above in the first embodiment, the ECU 3 determines the operating condition of the internal combustion engine on the basis of the information from the various sensors, and outputs the ignition signals IG1, IG2 such that a slight time difference of T1>T0 exists between the timings at which the two coil pairs provided in the ignition coil 2 are activated.

When the ignition signal IG2 shifts to the H level at the time T1, a primary current is supplied to the primary coil 21*b* of the coil pair having the ion current detection circuit 240, among the two coil pairs provided in the ignition coil 2, so that energy starts to be stored therein. At this time, the primary current starts to flow from the time T1 and gradually increases. Further, a secondary voltage serving as an induction voltage is generated in the secondary coil 22*b* and gradually decreases in accordance with the primary current.

Note that the secondary voltage generated in the secondary coil at the time T1 when the ignition signal IG2 shifts to the H level will be referred to hereafter as an "ignition signal ON induction voltage". The ignition signal ON induction voltage normally takes a maximum value of approximately 1 [kV]. Moreover, the ignition signal ON induction voltage is applied to the spark plug 1, and therefore, when a leak occurs in the spark plug 1, a leak current IL flows along the formed leak path 12 so as to be detected by the ion current detection circuit 240.

Here, the insulation resistance value of the spark plug 1 can be estimated using a following formula.

insulation resistance value of spark plug 1=ignition signal *ON* induction voltage/leak current *IL*

For example, the insulation resistance value of the spark plug 1 is calculated from the ignition signal ON induction voltage following an ON noise mask period of several hundred μs after the time T1, at which the ignition signal IG2 shifts to the H level, and the value of the leak current IL. Note that the ignition signal ON induction voltage takes a value obtained in advance by experiment.

Furthermore, the energization stoppage period Tb during which the ignition signal IG2 is temporarily switched to the L level may be set at a value within a range of several tens of μs to several hundred μs, which is obtained by applying a degree of leeway to a value obtained from a relationship between the insulation resistance value of the spark plug 1 obtained in advance by experiment and a period Tvb extending from the time T2, at which the negative high voltage starts to be generated, to a point at which a maximum dielectric breakdown voltage of 40 kV is reached, for example.

According to the third embodiment, as described above, the control unit detects the leakage condition of the spark plug on the basis of the ion current detected by the ion current detection circuit, and having detected a leak in the spark plug, sets the energization stoppage period to be longer than the reference period. More specifically, the control unit sets the energization stoppage period during which energization of the primary current is temporarily stopped on the basis of the leakage condition of the spark plug. Hence, in consideration of the possibility of a leak in the spark plug, it is possible to ensure that an unnecessarily large discharge secondary current is not supplied, and as a result, wear on the spark plug can be suppressed.

Further, the third embodiment of this invention may be combined with the method described in the first embodiment, in which the energization stoppage period Tb during which energization of the primary current is temporarily stopped is set on the basis of the operating condition of the internal combustion engine, and more specifically the high pressure condition in which a high voltage is required to generate the spark discharge.

For example, by ascertaining, in advance by experiment, the insulation resistance value of the spark plug 1, periods Tvb extending from the time T2 at which the negative high voltage starts to be generated to points at which respective dielectric breakdown voltages of 0 to 40 kV are reached, and a relationship between the operating condition and the dielectric breakdown voltage, it is possible to ensure even more reliably that an unnecessarily large discharge secondary current is not supplied, and as a result, wear on the spark plug can be suppressed.

Figure 6:
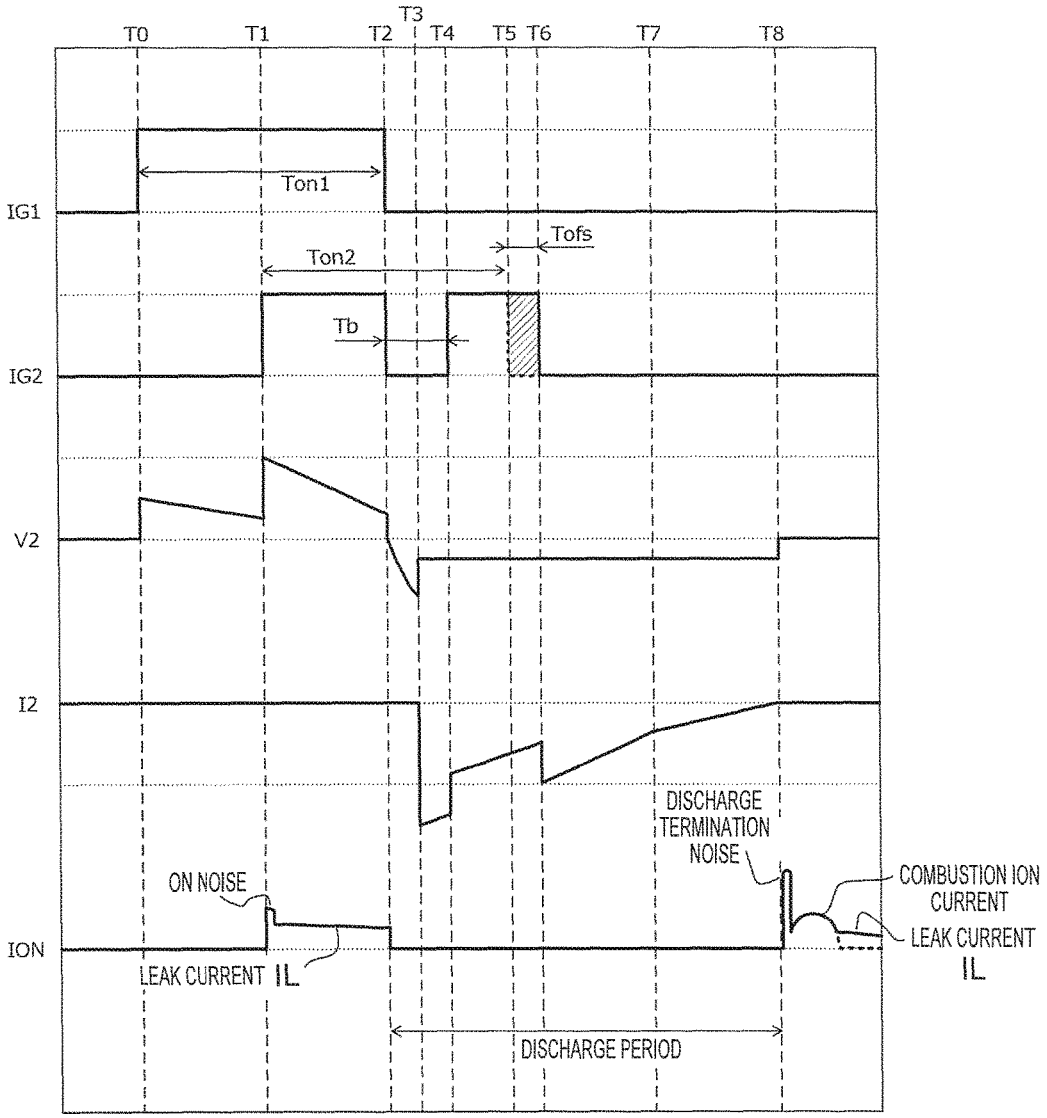
FIG. 6 is a timing chart showing an operation of the ignition control device for an internal combustion engine according to the third embodiment of this invention.

Furthermore, by providing the ion current detection circuit 240, an ion current generated during combustion can be detected from the time T8 onward in FIG. 6, and as a result, a misfire caused by deterioration of the ignitability and combustibility of the combustible air-fuel mixture due to EGR can also be detected.

Fourth Embodiment

Figure 7:
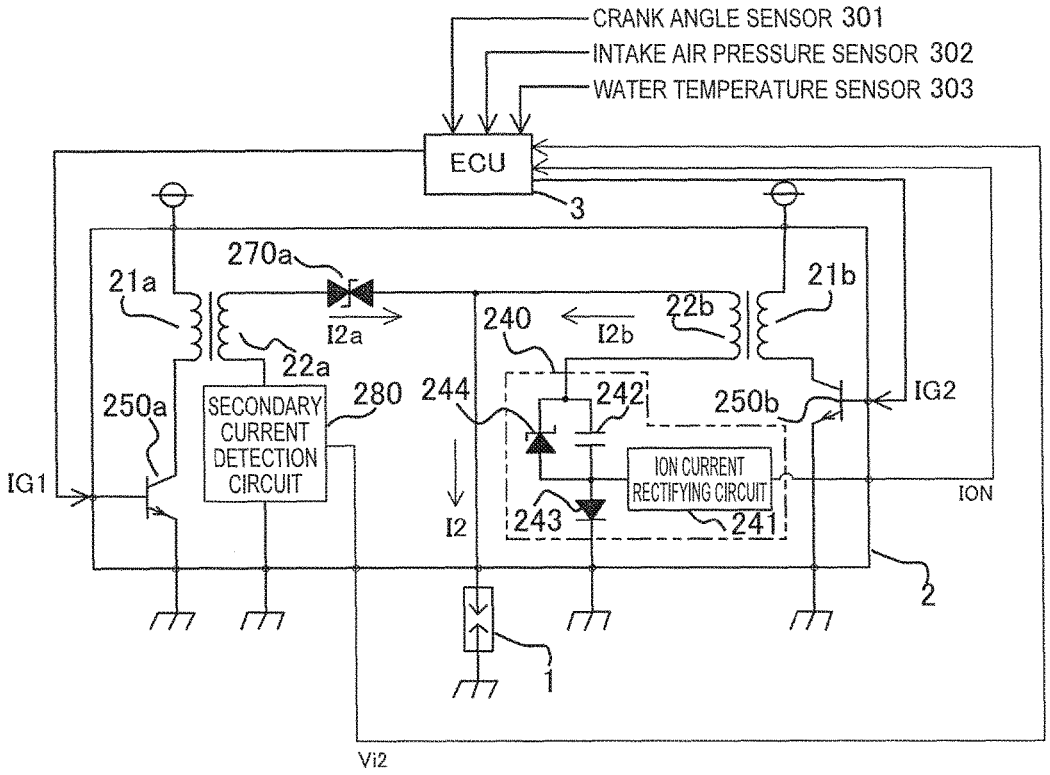
FIG. 7 is a view showing a configuration of an ignition control device for an internal combustion engine according to a fourth embodiment of this invention.

FIG. 7 is a view showing a configuration of an ignition control device for an internal combustion engine according to a fourth embodiment of this invention. In FIG. 7, the ignition coil 2 includes the secondary current detection circuit 280 that detects the discharge secondary current I2*a* supplied from the secondary coil 22*a*, and the ion current detection circuit 240 provided in relation to the secondary coil 22*b*. In other words, FIG. 7 shows a combination of FIGS. 4 and 5. All other configurations are identical to the first embodiment, shown in FIG. 1, and therefore description thereof has been omitted.

The ECU 3 obtains the secondary current output Vi2 output from the secondary current detection circuit 280 and the ion current ION output from the ion current detection circuit 240. Note that in the fourth embodiment of this invention, the secondary current detection circuit 280 and the ion current detection circuit 240 are both provided, but instead, either one thereof may be provided alone.

Figure 8:
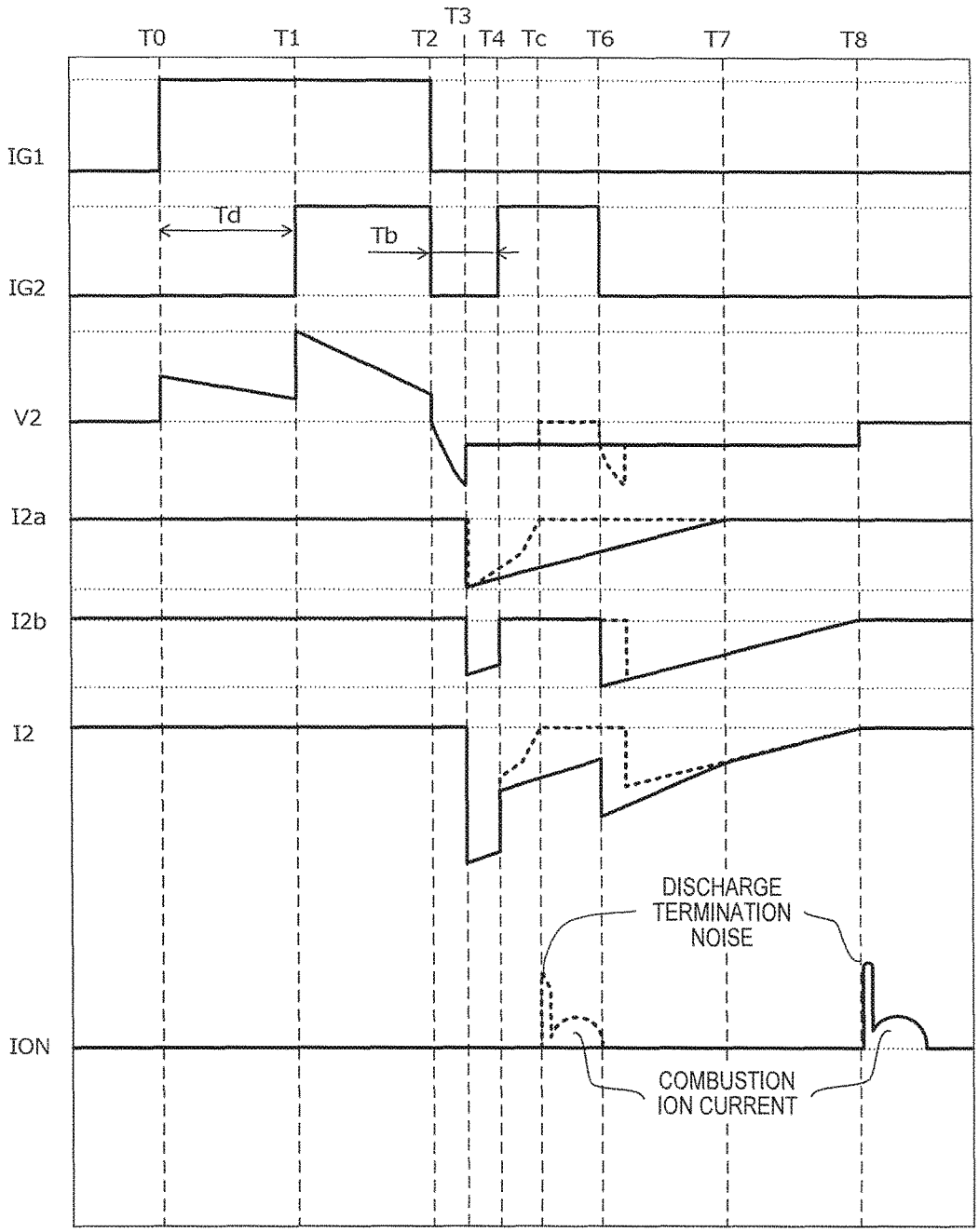
FIG. 8 is a timing chart showing an operation of the ignition control device for an internal combustion engine according to the fourth embodiment of this invention.

Next, referring to FIG. 8, a specific operation of the ignition control device for an internal combustion engine having the above configuration will be described. As described above in the first embodiment, dielectric breakdown occurs at the time T3, whereupon the discharge secondary current I2*a* is supplied to the spark plug 1 from the secondary coil 22*a*.

At this time, as described above in the second embodiment, the ECU 3 determines from the secondary current output Vi2 whether or not the discharge secondary current I2*a* is lower than a threshold set at −50 mA, for example.

When the discharge secondary current I2*a* is lower than the threshold, the ECU 3 switches the ignition signal IG2 from the L level to the H level in order to re-energize the primary coil 21*b*.

Next, at the time T6, the ignition signal IG2 is switched to the L level so that the discharge secondary current I2*b* is supplied likewise from the secondary coil 22*b*. As indicated by a dotted line waveform in the drawing, however, the spark discharge may be temporarily terminated at a time Tc prior to the time T6. The cause of this is believed to be an increase in a spark discharge maintenance voltage due to wear on the spark plug 1 and a flow increase in the combustion chamber.

When the spark discharge maintenance voltage increases, the energy in the ignition coil 2 is correspondingly more likely to be consumed, and therefore the spark discharge maintenance period shortens. As a result, the spark discharge is temporarily terminated, which may lead to combustion instability in an operating condition requiring a longer spark discharge period.

Hence, prior to the time T6 at which the ignition signal IG2 is switched to the L level, the ECU 3 determines whether or not the discharge secondary current I2*a* equals or exceeds a threshold set at 0 mA, for example, and when the discharge secondary current I2*a* equals or exceeds the threshold, determines that spark discharge maintenance has been interrupted.

Alternatively, prior to the time T6 at which the ignition signal IG2 is switched to the L level, the ECU 3 determines whether or not the ion current ION equals or exceeds a threshold set at 10 μA, for example, and when the ion current ION equals or exceeds the threshold, determines that spark discharge maintenance has been interrupted.

Further, when the spark discharge is terminated at the time Tc, a noise current is generated in accordance with the inductance of the secondary coil 22*b* of the ignition coil 2, stray capacitance on the secondary coil side of the ignition coil 2, and LC resonance in the capacitor 242. The noise current caused by the LC resonance flows to the ion current detection circuit 240, and therefore only a normal direction current is detected as a discharge termination noise current.

The combustion ion current is then detected before the time T6. Hence, by determining whether or not the ion current ION equals or exceeds a predetermined value prior to the time T6, it is possible to determine whether or not spark discharge maintenance has been interrupted.

After determining that spark discharge maintenance has been interrupted, the ECU 3 first switches the ignition signal IG1 to the H level at the time T0 during a following self-ignition stroke, and then sets a period Td extending to the time T1, at which the ignition signal IG2 is switched to the H level, to be shorter than a reference time difference constituted by the slight time difference described in the first to third embodiments. As a result, the time T6 approaches the time Tc, and when T6<Tc, an interruption in spark discharge maintenance can be prevented.

Meanwhile, the period from the time T1 at which the ignition signal IG2 is switched to the H level to the time T2 at which the ignition signal IG2 is switched to the L level lengthens, leading to increases in the amount of primary current supplied to the primary coil 21*b* and the period during which the primary current is supplied. As a result, heat is more likely to be generated by the ignition coil 2 than in the previous self-ignition stroke.

Accordingly, the energization stoppage period Tb during which the ignition signal IG2 is temporarily switched to the L level may be lengthened. Further, the energization stoppage period Tb may be set such that the primary current supplied to the primary coil 21*a* at the time T3 and the primary current supplied to the primary coil 21*b* at the time T6 are at identical levels. Furthermore, when leeway remains to a heat generation limit of the ignition coil 2 in a low rotation operating condition or the like, respective ON periods of the ignition signals IG1, IG2 may be lengthened.

According to the fourth embodiment, as described above, the control unit detects the spark discharge maintenance condition of the spark plug after the primary current supplied to the first primary coil is interrupted on the basis of the output of at least one of the secondary current detection circuit and the ion current detection circuit. Having determined that spark discharge maintenance has been interrupted, the control unit energizes the primary current supplied to the first primary coil during the following self-ignition stroke, and then sets the period extending to energization of the primary current supplied to the second primary coil to be shorter than the reference time difference and sets the energization stoppage period to be longer than the reference period.

Hence, a situation in which spark discharge maintenance is interrupted continuously can be prevented from occurring even when the spark discharge maintenance voltage increases due to wear on the spark plug and a flow increase in the combustion chamber, and as a result, continuous combustion instability can be prevented.

Fifth Embodiment

In the first to fourth embodiments, as shown in FIG. 2, the spark discharge is maintained for a longer period by inserting a slight time difference of T1>T0 between the respective timings at which the two coil pairs provided in the ignition coil 2 are activated.

Figure 9:
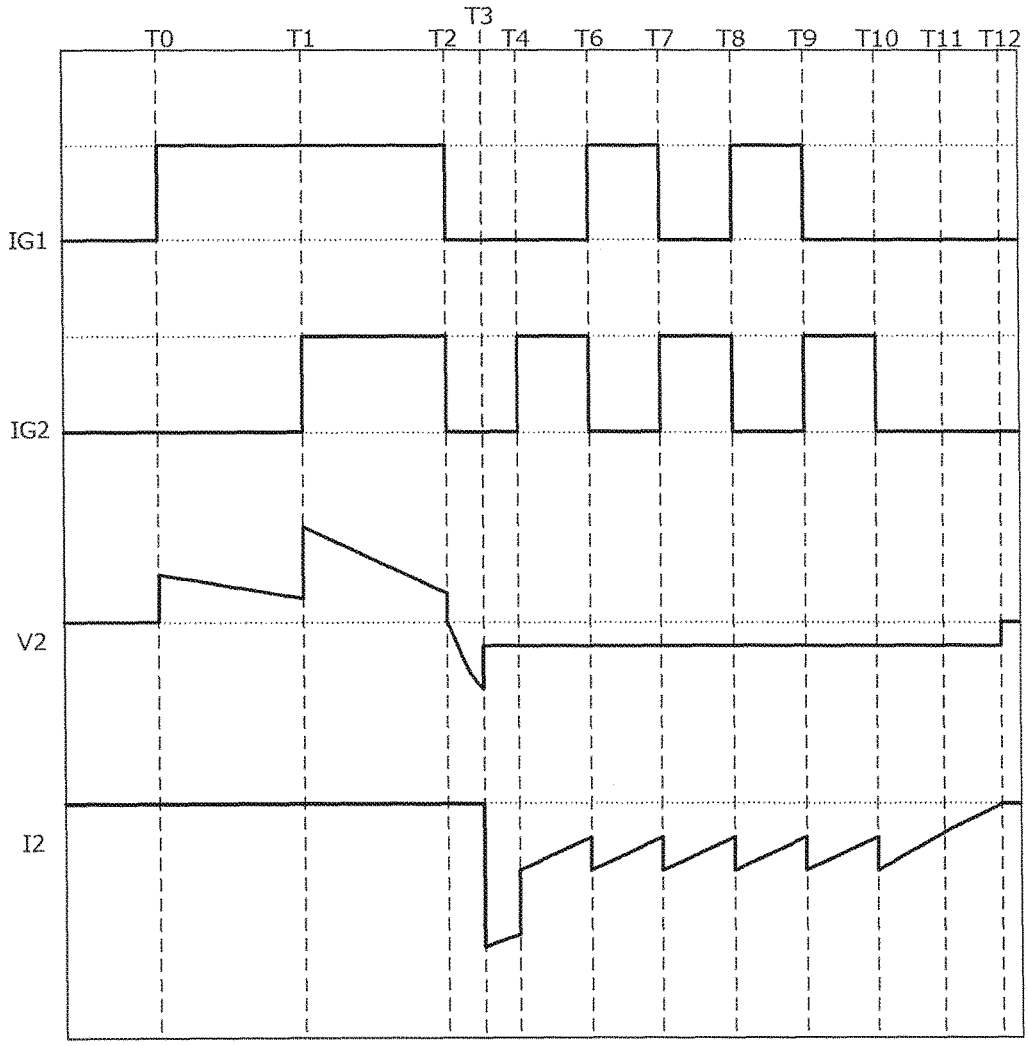
FIG. 9 is a timing chart showing an operation of an ignition control device for an internal combustion engine according to a fifth embodiment of this invention.

Here, as shown in FIG. 9, the spark discharge may be maintained for a longer period likewise by performing alternate ignition operations in which the ignition signal IG1 is switched back to the H level at the time T6, when the ignition signal IG2 is switched to the L level, and the ignition signal IG2 is switched back to the H level at the time T7.

According to the fifth embodiment, as described above, the ignitability of the combustible air-fuel mixture can be stabilized and a more stable flame kernel can be formed. As a result, the combustibility can be stabilized.

Note that the respective embodiments of this invention may be combined freely and modified or omitted as appropriate within the scope of the invention.

What is claimed is:

1. An ignition control device for an internal combustion engine comprising:

a spark plug that includes a first electrode and a second electrode disposed so as to oppose each other via a gap, and generates a spark discharge in the gap in order to ignite a combustible air-fuel mixture existing in a combustion chamber of the internal combustion engine;

an ignition coil that includes a plurality of sets of a primary coil and a secondary coil, generates a high voltage in the secondary coil by energizing or interrupting a primary current supplied to the primary coil, and applies the generated high voltage to the first electrode; and a control unit that, in a case where a plurality of the primary coils are driven during a single ignition process, temporarily stops energization of a primary current supplied to a second primary coil when a primary current supplied to a first primary coil is interrupted, and re-energizes the primary current supplied to the second primary coil following the elapse of an energization stoppage period.

2. The ignition control device for an internal combustion engine according to claim 1, wherein the control unit sets the energization stoppage period, in which energization of the primary current supplied to the second primary coil is temporarily stopped, on the basis of an operating condition of the internal combustion engine.

3. The ignition control device for an internal combustion engine according to claim 2, wherein the control unit sets the energization stoppage period to be longer than a reference period when the operating condition of the internal combustion engine corresponds to a high pressure condition in which a high voltage is required to generate the spark discharge.

4. The ignition control device for an internal combustion engine according to claim 1, wherein the ignition coil includes a secondary current detection circuit that detects a current supplied to the secondary coil that is coupled to the first primary coil in which the primary current is interrupted, and the control unit re-energizes the primary current supplied to the second primary coil on the basis of the current detected by the secondary current detection circuit after interrupting the primary current supplied to the first primary coil.

5. The ignition control device for an internal combustion engine according to claim 1, wherein the ignition coil includes an ion current detection circuit that detects an ion current that flows in accordance with an amount of ions generated in the combustion chamber when the combustible air-fuel mixture in the combustion chamber is burned by the spark discharge, and the control unit detects a leakage condition of the spark plug on the basis of the ion current detected by the ion current detection circuit, and sets the energization stoppage period to be longer than a reference period after detecting a leak in the spark plug.

6. The ignition control device for an internal combustion engine according to claim 2, wherein the ignition coil includes an ion current detection circuit that detects an ion current that flows in accordance with an amount of ions generated in the combustion chamber when the combustible air-fuel mixture in the combustion chamber is burned by the spark discharge, and the control unit detects a leakage condition of the spark plug on the basis of the ion current detected by the ion current detection circuit, and sets the energization stoppage period to be longer than a reference period after detecting a leak in the spark plug.

7. The ignition control device for an internal combustion engine according to claim 3, wherein the ignition coil includes an ion current detection circuit that detects an ion current that flows in accordance with an amount of ions generated in the combustion chamber when the combustible air-fuel mixture in the combustion chamber is burned by the spark discharge, and the control unit detects a leakage condition of the spark plug on the basis of the ion current detected by the ion current detection circuit, and sets the energization stoppage period to be longer than a reference period after detecting a leak in the spark plug.

8. The ignition control device for an internal combustion engine according to claim 4, wherein the ignition coil includes an ion current detection circuit that detects an ion current that flows in accordance with an amount of ions generated in the combustion chamber when the combustible air-fuel mixture in the combustion chamber is burned by the spark discharge, and the control unit detects a leakage condition of the spark plug on the basis of the ion current detected by the ion current detection circuit, and sets the energization stoppage period to be longer than a reference period after detecting a leak in the spark plug.

9. The ignition control device for an internal combustion engine according to claim 1, wherein the ignition coil includes at least one of a secondary current detection circuit that detects a current supplied to the secondary coil that is coupled to the first primary coil in which the primary current is interrupted and an ion current detection circuit that detects an ion current that flows in accordance with an amount of ions generated in the combustion chamber when the combustible air-fuel mixture in the combustion chamber is burned by the spark discharge, and the control unit detects a spark discharge maintenance condition of the spark plug following interruption of the primary current supplied to the first primary coil on the basis of output from at least one of the secondary current detection circuit and the ion current detection circuit, and having determined that spark discharge maintenance has been interrupted, energizes the primary current supplied to the first primary coil during a following self-ignition stroke, and then sets a period extending to energization of the primary current supplied to the second primary coil to be shorter than a reference time difference and sets the energization stoppage period to be longer than a reference period.

10. The ignition control device for an internal combustion engine according to claim 1, wherein the control unit sets a re-energization period during which the primary current supplied to the second primary coil is re-energized in accordance with the energization stoppage period.

11. The ignition control device for an internal combustion engine according to claim 2, wherein the control unit sets a re-energization period during which the primary current supplied to the second primary coil is re-energized in accordance with the energization stoppage period.

12. The ignition control device for an internal combustion engine according to claim 3, wherein the control unit sets a re-energization period during which the primary current supplied to the second primary coil is re-energized in accordance with the energization stoppage period.

13. The ignition control device for an internal combustion engine according to claim 4, wherein the control unit sets a re-energization period during which the primary current supplied to the second primary coil is re-energized in accordance with the energization stoppage period.

14. The ignition control device for an internal combustion engine according to claim 5, wherein the control unit sets a re-energization period during which the primary current supplied to the second primary coil is re-energized in accordance with the energization stoppage period.

15. The ignition control device for an internal combustion engine according to claim 6, wherein the control unit sets a re-energization period during which the primary current supplied to the second primary coil is re-energized in accordance with the energization stoppage period.

16. The ignition control device for an internal combustion engine according to claim 7, wherein the control unit sets a re-energization period during which the primary current supplied to the second primary coil is re-energized in accordance with the energization stoppage period.

17. The ignition control device for an internal combustion engine according to claim 8, wherein the control unit sets a re-energization period during which the primary current supplied to the second primary coil is re-energized in accordance with the energization stoppage period.

18. The ignition control device for an internal combustion engine according to claim 9, wherein the control unit sets a re-energization period during which the primary current supplied to the second primary coil is re-energized in accordance with the energization stoppage period.

19. An ignition control method for an internal combustion engine, which is realized in an internal combustion engine comprising:

a spark plug that includes a first electrode and a second electrode disposed so as to oppose each other via a gap, and generates a spark discharge in the gap in order to ignite a combustible air-fuel mixture existing in a combustion chamber of the internal combustion engine; and an ignition coil that includes a plurality of sets of a primary coil and a secondary coil, generates a high voltage in the secondary coil by energizing or interrupting a primary current supplied to the primary coil, and applies the generated high voltage to the first electrode, wherein the ignition control method is implemented in a case where a plurality of the primary coils are driven during a single ignition process, and comprises the steps of:

temporarily stopping energization of a primary current supplied to a second primary coil when a primary current supplied to a first primary coil is interrupted; and re-energizing the primary current supplied to the second primary coil following the elapse of an energization stoppage period.

* * * * *